United States Patent [19]

Myers

[11] Patent Number: 4,529,953

[45] Date of Patent: Jul. 16, 1985

[54] ELECTRICAL SWITCH

[75] Inventor: Michael J. Myers, Goshen, Ind.

[73] Assignee: Electromation, Inc., Elkhart, Ind.

[21] Appl. No.: 413,693

[22] Filed: Sep. 1, 1982

[51] Int. Cl.[3] ..... H01H 67/02

[52] U.S. Cl. ..... 335/126; 335/136; 335/159

[58] Field of Search ..... 335/159, 187, 136, 133, 335/131, 126; 200/1 V, 16 A

[56] References Cited

U.S. PATENT DOCUMENTS

| | | | |
|---|---|---|---|
| 2,885,516 | 5/1959 | Goudy et al. | 335/133 |
| 3,155,790 | 11/1964 | Lemonnier | 333/124 |
| 3,815,060 | 6/1974 | Turnbull | 335/133 |
| 3,836,879 | 9/1974 | Frye | 335/136 |
| 4,041,426 | 8/1977 | Zemanek et al. | 335/126 |
| 4,259,652 | 3/1981 | Mattson | 335/136 |
| 4,293,835 | 10/1981 | Davis et al. | 335/131 |

*Primary Examiner*—Peter S. Wong
*Assistant Examiner*—Jeffrey Sterrett
*Attorney, Agent, or Firm*—James D. Hall

[57] ABSTRACT

An electrical switch assembly which employs opposed solenoid actuators in association with a pair of biased contact plates.

5 Claims, 6 Drawing Figures

ELECTRICAL SWITCH

SUMMARY OF THE INVENTION

This invention relates to an electrical switch assembly.

One of the major difficulties encountered when using conventional switches to control the electrical power input to a vibrating load is the problem of arcing. Such arcing not only lessens switch life, but also tends to produce electrical sparks. This problem of switch arcing becomes enhanced when the switch is used to actuate controls on a motor boat or similar device in which oil and gasoline fumes and slicks are in close proximity to the switch. Also, conventional switches are often bulky, and include multiple wiring, rendering them very difficult to service and repair.

The switch of this invention serves to rectify many of the problems inherent in conventional switches or relays. By employing a pair of opposed electrical actuators in association with biased contact plates, an efficient switch is formed which is resistant to vibration. The switch also acts as a failsafe mechanism which automatically cuts off power if both actuators are energized at the same time. By varying the position of the switch contacts, through energization of individual actuators, the switch is used in a single pole double throw mode. Also, the package size for the switch is relatively small and requires less wiring than conventional type switches, making it easier to service and repair.

Accordingly, it is an object of this invention to provide a novel electrical switch to control the power to a permanent magnetic motor.

Another object of this invention is to provide an electrical switch which is highly resistant to vibration.

Another object of this invention is to provide an improved single pole double throw electrical switch.

Still another object of this invention is to provide an electrical switch which is economical and efficient to maintain.

Other objects of this invention will become apparent upon a reading of the following description.

DESCRIPTION OF THE PREFERRED EMBODIMENT

Figure 2:
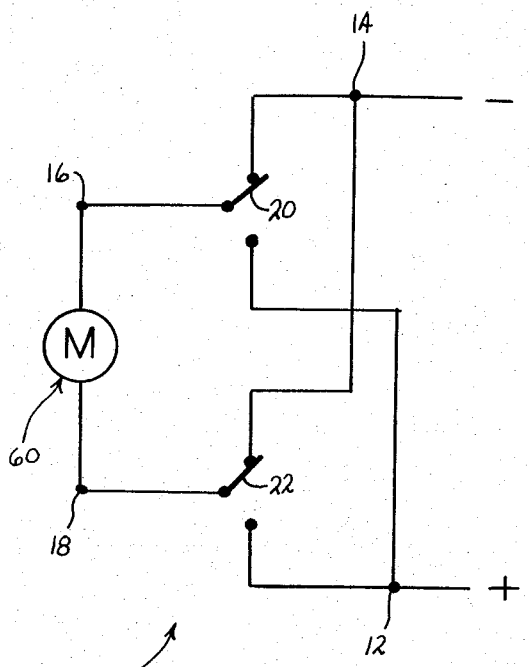
FIG. 2 is a circuit diagram showing the components of the switch in their neutral position, as shown in FIG. 1, with the switch connected between a motor and a power source.

The preferred embodiment illustrated is not intended to be exhaustive or to limit the invention to the precise form disclosed. It is chosen to describe or to best explain the principles of the invention and its application and practical use to thereby enable others skilled in the art to best utilize the invention.

The switch 10 of this invention includes spaced, separated power input terminals 12 and 14. Switch 10 also includes separated power output terminals 16 and 18, and two washer shaped conductive contacts 20, 22 which join input terminals 12, 14 with output terminals 16, 18 to form an electrical circuit through the switch.

Input terminal 12 includes spaced L-shaped terminal parts 24, 26 and input terminal 14 includes spaced L-shaped terminal parts 28, 30. Terminal parts 24, 28 are adjacently spaced from each other as are parts 26, 30. Output terminal 16 includes adjacently spaced terminal parts 32, 34 which are aligned with input terminal parts 24, 28. Output terminal 18 includes adjacently spaced terminal parts 36, 38 which are aligned with input terminal parts 26, 30.

Figure 1:
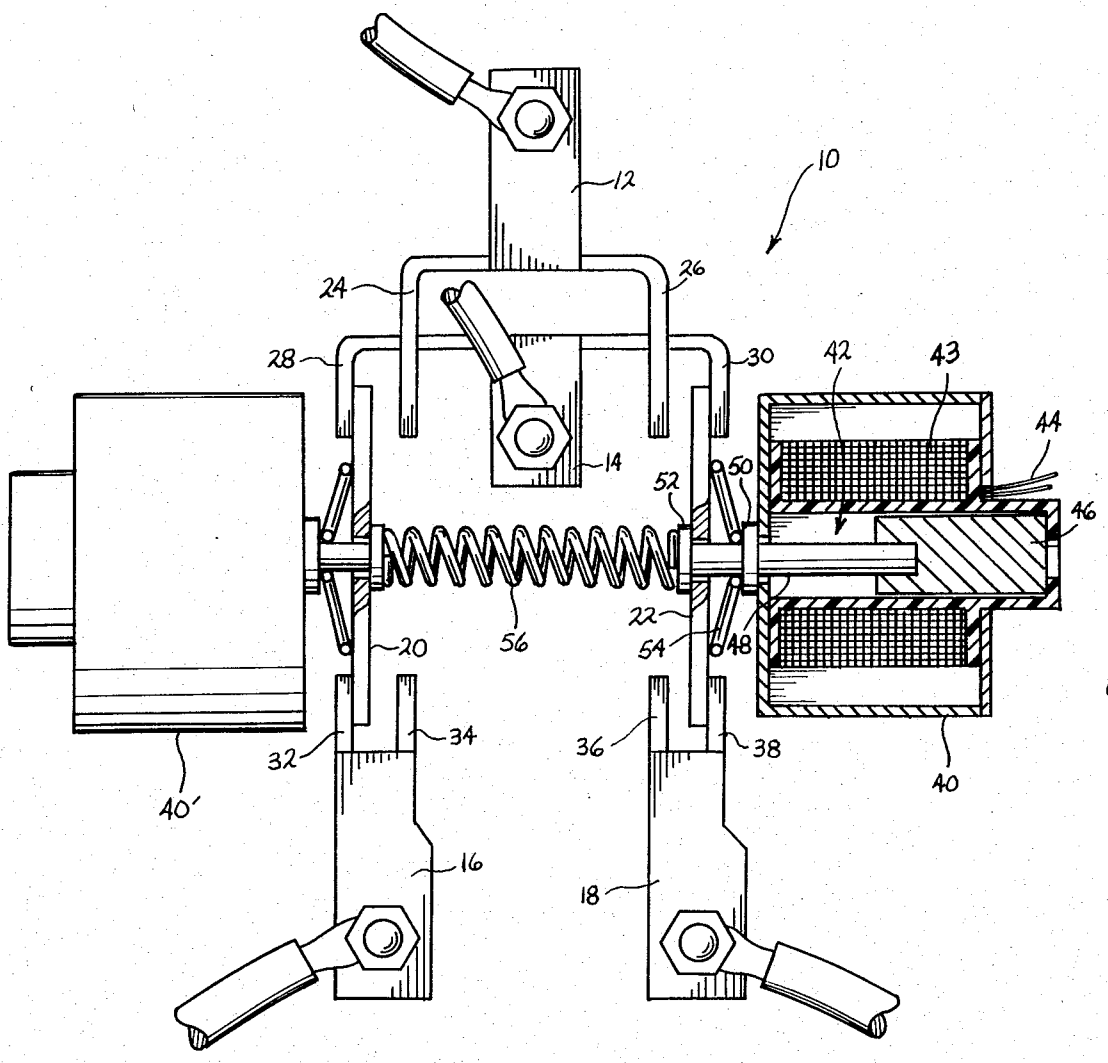
FIG. 1 is a plan view of the switch in its neutral position, with portions shown in section for purposes of illustration.
Figure 3:
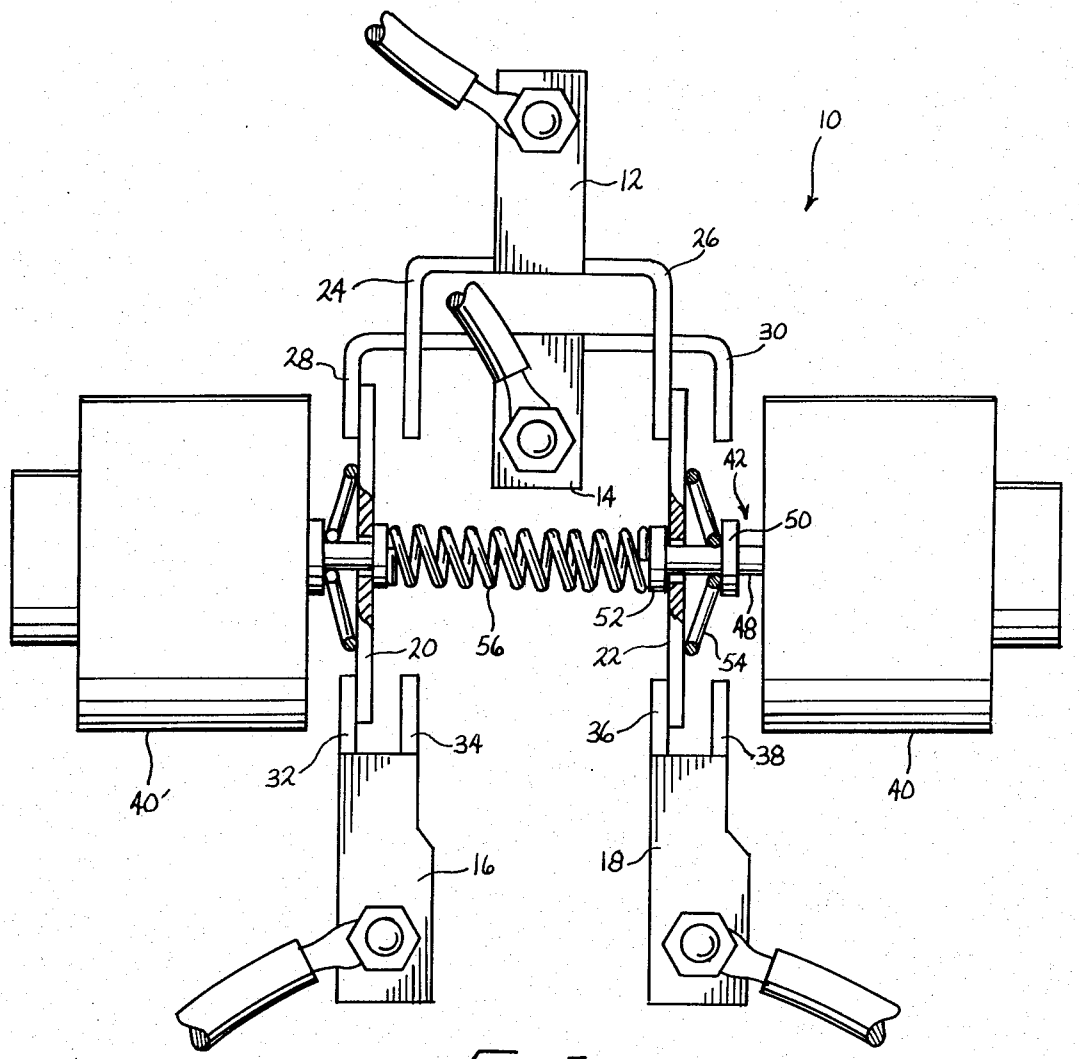
FIG. 3 is a plan view of the switch in one operative position.
Figure 5:
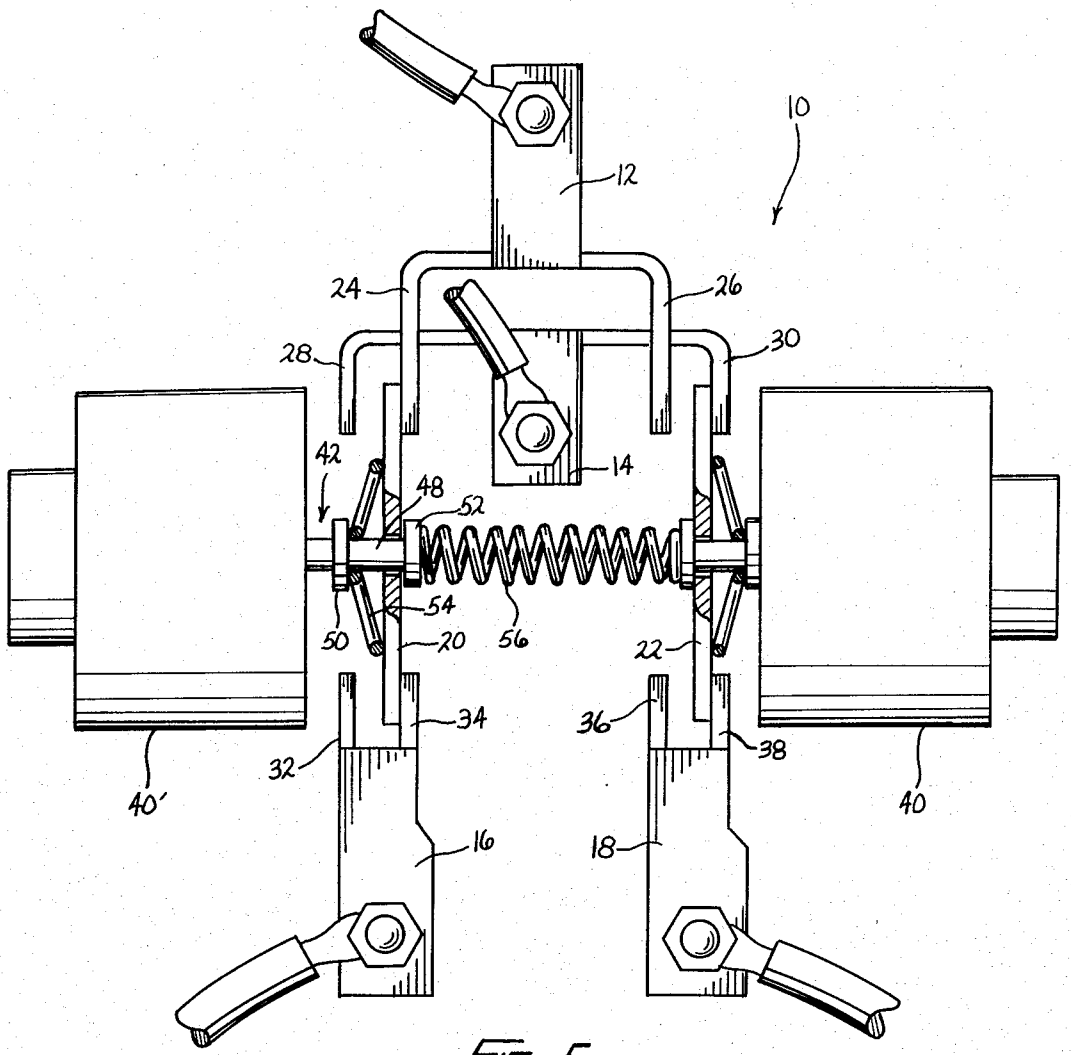
FIG. 5 is a plan view of the switch in another operative position.

Contact 20 is located with its periphery extending between input terminals 24 and 28 and output terminals 32 and 34 and is capable of being shifted between a first position, shown in FIGS. 1 and 3, contacting terminal parts 28, 32, and a second position, shown in FIG. 5, contacting terminal parts 24, 34. Contact 22 is located with its periphery extending between input terminals 26 and 30 and output terminals 36 and 38 and is shiftable between a first position, shown in FIGS. 1 and 5, contacting terminal parts 30, 38, and a second position, shown in FIG. 3, contacting terminal parts 26, 36. The positioning of each individual contact 20, 22 will determine the polarity of the current through the switch. When contacts 20, 22 are both located in either their first or second positions as described above, no current will flow through switch 10.

Switch 10 also includes opposed solenoid actuators 40, 40'. Each actuator 40, 40' includes a centrally located plunger 42, whose extended and retracted movements are caused by the energizing of coil 43 through conductors 44. Plunger 42 includes a ferrite base part 46 and a non-conductive pin 48. Each pin 48 extends through a corresponding contact 20, 22 and terminates in a head 52 located on the opposite side of the contact. A conical spring 54 is positioned about each pin 48 and is located between a collar 50 of the pin and the contact 20, 22. Each spring 54 urges its corresponding contact 20, 22 against head 52 of plunger 42. A helical spring 56, insulated from contacts 20, 22, extends between plunger heads 52 and serves to normally urge contact 20 into firm engagement with terminal parts 28 and 32 and to normally urge contact 22 into firm engagement with terminal parts 30 and 38.

As shown in FIG. 1, switch 10 is in its neutral position, neither actuator 40, 40' having been energized. Each plunger 42 is in a retracted position, allowing helical spring 56 to urge contacts 20 and 22, into contact with parts 28 and 30 of output terminal 14. In this position, shown diagramatically in FIG. 2, no current is carried through the resulting circuit 58 to motor 60. The same no current result would occur if each actuator 40, 40' had been energized at the same time to cause contacts 20 and 22 to engage terminal parts 24 and 26.

Figure 4:
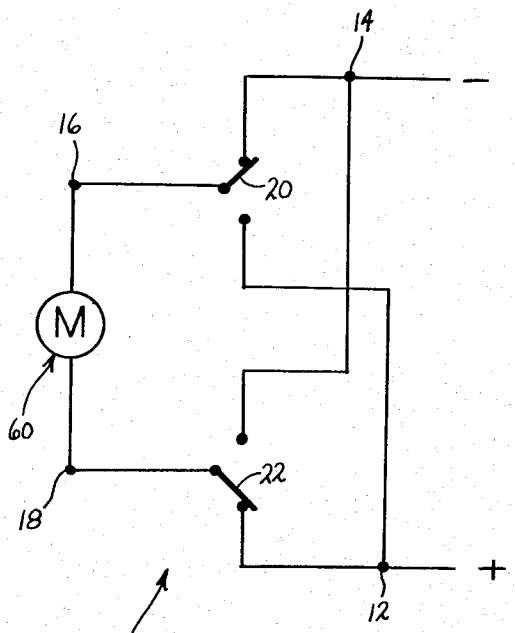
FIG. 4 is a circuit diagram showing the components of the switch in their one operative position, as shown in FIG. 3.

As shown in FIG. 3, only actuator 40 has been energized with its conical spring 54 urging contact 22 into firm engagement with terminal parts 26, 36. The corresponding pressure applied by the movement of plunger 42 of actuator 40 to helical spring 56 causes the helical spring to urge contact 20 into firm engagement with terminal parts 28, 32. When switch 10 is in this position, as shown diagramatically in FIG. 4, a current passes through circuit 58, serving to actuate motor 60.

Figure 6:
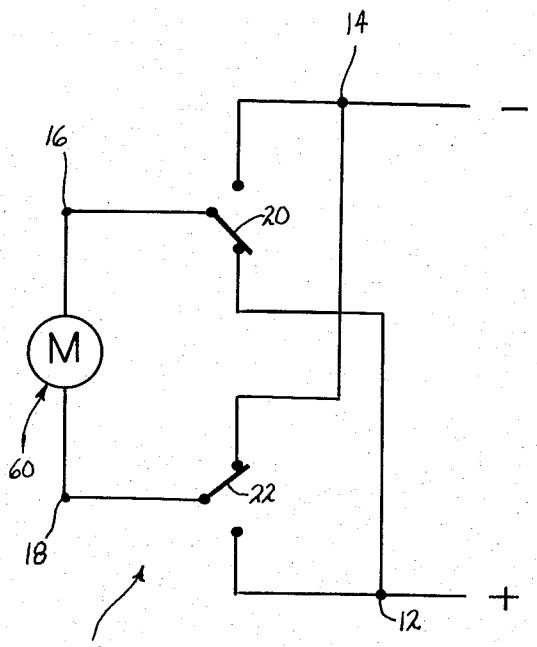
FIG. 6 is a circuit diagram showing the components of the switch in their other operative position, as shown in FIG. 5.

A third switch position is shown in FIG. 5, with only actuator 40' having been energized and its conical spring 54 urging contact 20 into firm engagement with terminal parts 24, 34. Helical spring 56 serves to urge contact 22 into firm engagement with terminal parts 30, 38. Resulting circuit 58, as shown diagramatically in FIG. 6, will pass a current of opposite polarity to motor 60.

Since each contact 20, 22 is constantly in firm engagement with a corresponding terminal part at all times due to the biasing effect of conical springs 54 and helical spring 56, switch 10 will normally operate with no vibratory arcing.

It is to be understood that this invention is not to be limited to the details above given, but may be modified within the scope of the appended claims.

What I claim is:

1. An electrical switch comprising first and second power terminals, each first and second terminals including spaced terminal parts, third and fourth power terminals, one terminal part of said first terminal located adjacently spaced from one terminal part of said second terminal, the other terminal part of said first terminal located adjacently spaced from the other terminal of said second terminal, a first contact located at least in part between said one terminal parts of the first and second terminals, a second contact located at least in part between said other terminal parts of said first and second terminals, said first contact being shiftable between a first position contacting said one terminal part of the first terminal and said third terminal and a second position contacting said one terminal part of the second terminal and said third terminal, said second contact being shiftable between a first position contacting said other terminal part of the first terminal and said fourth terminal and a second position position contacting the other terminal part of the second terminal and said fourth terminal, means for independently shifting said first and second contacts between their said first and second positions, said means for shifting said contacts including opposed actuators capable of independent energization, each of said actuators including a shiftable plunger part carrying a said contact, each actuator plunger part being shiftable between retracted and extended positions for shifting its carried contact between its said first and second positions respectively, and biasing means yieldable upon plunger part movement located between said contacts for normally urging each contact into its said first position.

2. The switch of claim 1 wherein said contacts are oppositely located, said biasing means constituting a spring extending between said contacts with one end of the spring being shiftable with said first contact and the other end of said spring being shiftable with said second contact.

3. The switch of claim 2 and other biasing means carried by each plunger part in engagement with the contact carried thereby for urging such contact into terminal part engagement when the contact is in its said second position.

4. The switch of claim 2 wherein said third and fourth terminals includes a pair of adjacently spaced terminal parts, said first contact located at least in part between said terminal parts of the third terminal and contacting one such terminal part when in its said first position and contacting the other such terminal part of the third terminal when in its said second position, said second contact located at least in part between said terminal parts of the fourth terminal and contacting one such terminal part when in its said first position and contacting the other such terminal part of the fourth terminal when in its said second position.

5. The switch of claim 4 wherein said contacts are each washer-shaped and have a central opening receiving a said plunger part, the peripheral edge of said first contact located between said one terminal parts of the first and second terminals and between said terminal parts of the third terminal, the peripheral edge of said second contact located between said other terminal parts of the first and second terminals and between said terminal parts of the fourth terminal.

* * * * *